US005488755A

United States Patent [19]

Chang

[11] Patent Number: 5,488,755

[45] Date of Patent: Feb. 6, 1996

[54] MULTI-FUNCTIONAL HANDGRIP

[76] Inventor: John Chang, No. 1-2, Lane 975, Chun-Jih Road, Tao-Yuan City, Taiwan

[21] Appl. No.: 254,901

[22] Filed: Jun. 6, 1994

[51] Int. Cl.[6] ..... A47B 95/02; A63B 23/16

[52] U.S. Cl. ..... 16/111 R; 16/DIG. 12; 482/49

[58] Field of Search ..... 16/111 R, 110 R, 16/110.5, DIG. 12; 482/49, 128

[56] References Cited

U.S. PATENT DOCUMENTS

| | | | |
|---|---|---|---|
| 3,442,132 | 5/1969 | Mare | 482/49 |
| 4,308,762 | 1/1982 | Jannard | 16/110 R |
| 4,577,858 | 3/1986 | Higami | 482/44 |
| 4,865,317 | 9/1989 | Hickey | 482/128 |
| 5,147,256 | 9/1992 | Silagy | 482/47 |

*Primary Examiner*—P. Austin Bradley

*Assistant Examiner*—Chuck Y. Mah

*Attorney, Agent, or Firm*—Morton J. Rosenberg; David I. Klein

[57] ABSTRACT

A multi-functional handgrip comprises a pair of U-shape frames which are slidably engaged with each other through the insert and connecting block disposed at both ends. Each of the connecting block of the U-shape frame is provided with a spring member which provided a biasing force to the insert to be received thereof. A holding bar is disposed at the U-shape frames for grasping. The holding bar is provided with a plurality of projections at the outer surface and a permanent magent installed within the holding bar. A cover is attached to the connecting block to retain a stack within the connecting block. By this arrangement, the multi-functional handgrip facilitates an adjustment on the operating torque. Besides, the projections of the holding bar provide an excellent effect when the part of the body is massaged. A portable and compact handgrip is achieved.

5 Claims, 14 Drawing Sheets

MULTI-FUNCTIONAL HANDGRIP

BACKGROUND OF THE INVENTION

This invention relates to a handgrip, more particularly, to a multi-functional handgrip wherein the gripping torque of the handgrip is adjustable for different applications. Besides, the handgrip can be served as a massager to the body.

As shown in FIG. 1, the conventional handgrip 1 generally includes a spring member 12 incorporated with a handlebar 11 at both ends. Those two handlebar 11 are angularly spaced with each other. Basically, the conventional handgrip is designed for an exercise to the palm. No other application can be made. On the other hand, the spring 12 has a predetermined ratings which can not be adjusted by the user. In most cases, the ratings of the spring are too large to be gripped by the common people, especially for the women and the young. Only a comparable strong people with a strong wrist muscle can manipulate it.

On the other hand, the old people holds a pair of metal balls 13 within their palm and makes the ball spin with each other to perform an exercise or massage to their fingers and palm. Accordingly, the distal recirculation is improved. Spinning this metal balls within the palm is comparably moderate than the handgrip. But this metal balls are comparably heavy and not portable. Besides, the metal balls are sold in pairs, only one hand can conduct an exercise at one time. Accordingly, only the old people would like to take this metal ball as a sporting equipment.

Those above described handgrip and metal balls are only suitable for one hand exercise. They can not be applied to other part of the body, such as a massager. Above all, these sporting equipment are simple without other functions, it is hardly to make the exercise long.

SUMMARY OF THE INVENTION

It is the object of this invention to provide a multi-functional handgrip wherein the operating torque of the handgrip can be adjusted to apply different loads to the wrist.

It is still the object of this invention to provide a multi-functional handgrip which can be used as a massager to massage the hand as well as the sole and other part of the body.

It is still another object of this invention to provide a multi-functional handgrip which is incorporated with a plurality of metal balls suitable for massage the hand to increase the distal recirculation.

It is still the further object of this invention to provide a multi-functional handgrip wherein the design of the handgrip is compact and portable.

BRIEF DESCRIPTION OF THE DRAWINGS

The objects and other advantages of the present invention will become more apparently as in conjunction with a preferred embodiment and drawings accompanied thereof; wherein

FIG. 12A is an enlarged view of the locking mechanism shown in FIG. 12;

FIG. 18A is a top view showing the spinning of the holding bars within the user's hand;

DETAILED DESCRIPTION OF THE REFERRED EMBODIMENT

Figure 3:
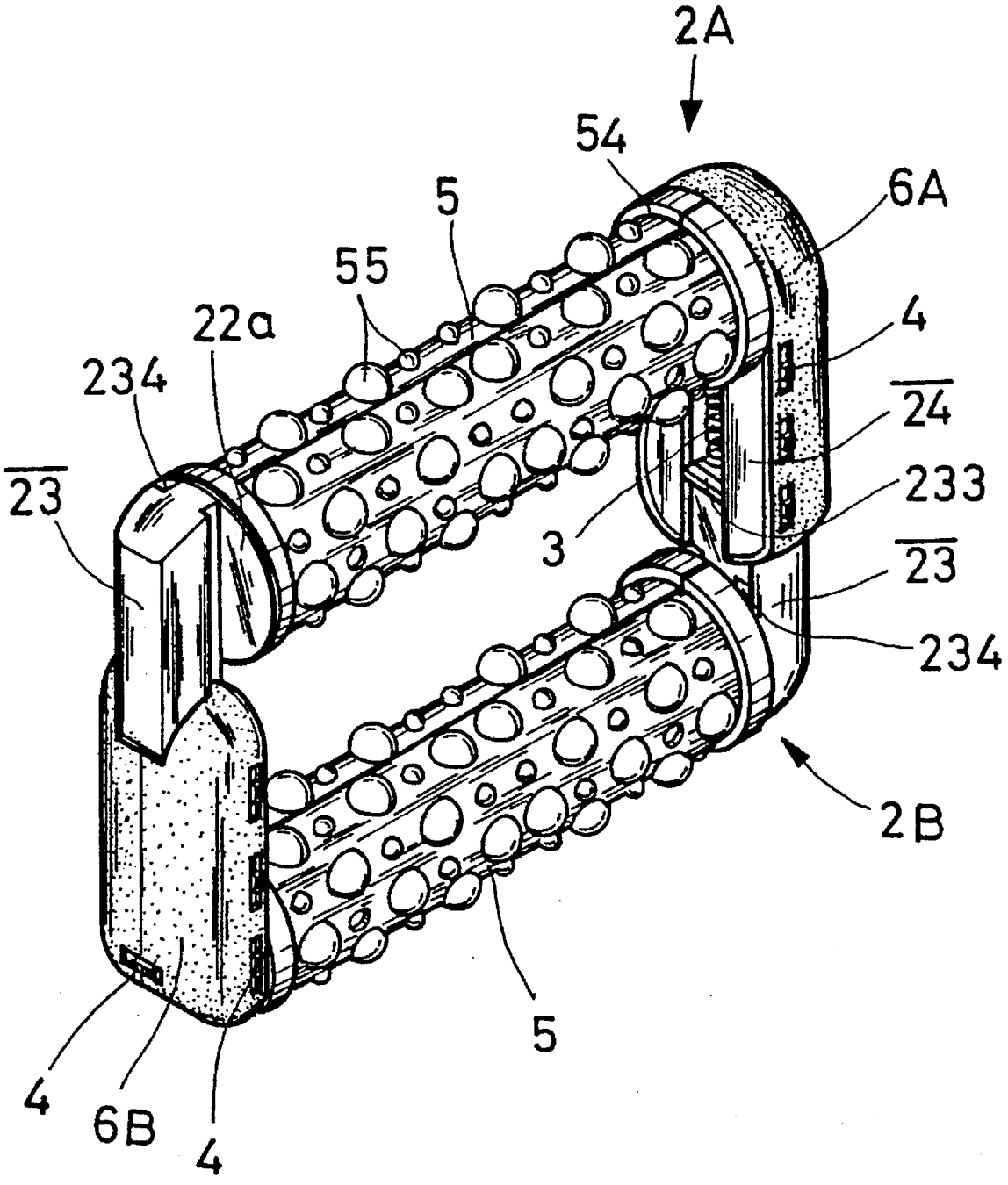
FIG. 3 is a perspective view of the multi-functional handgrip made according to this invention.
Figure 4:
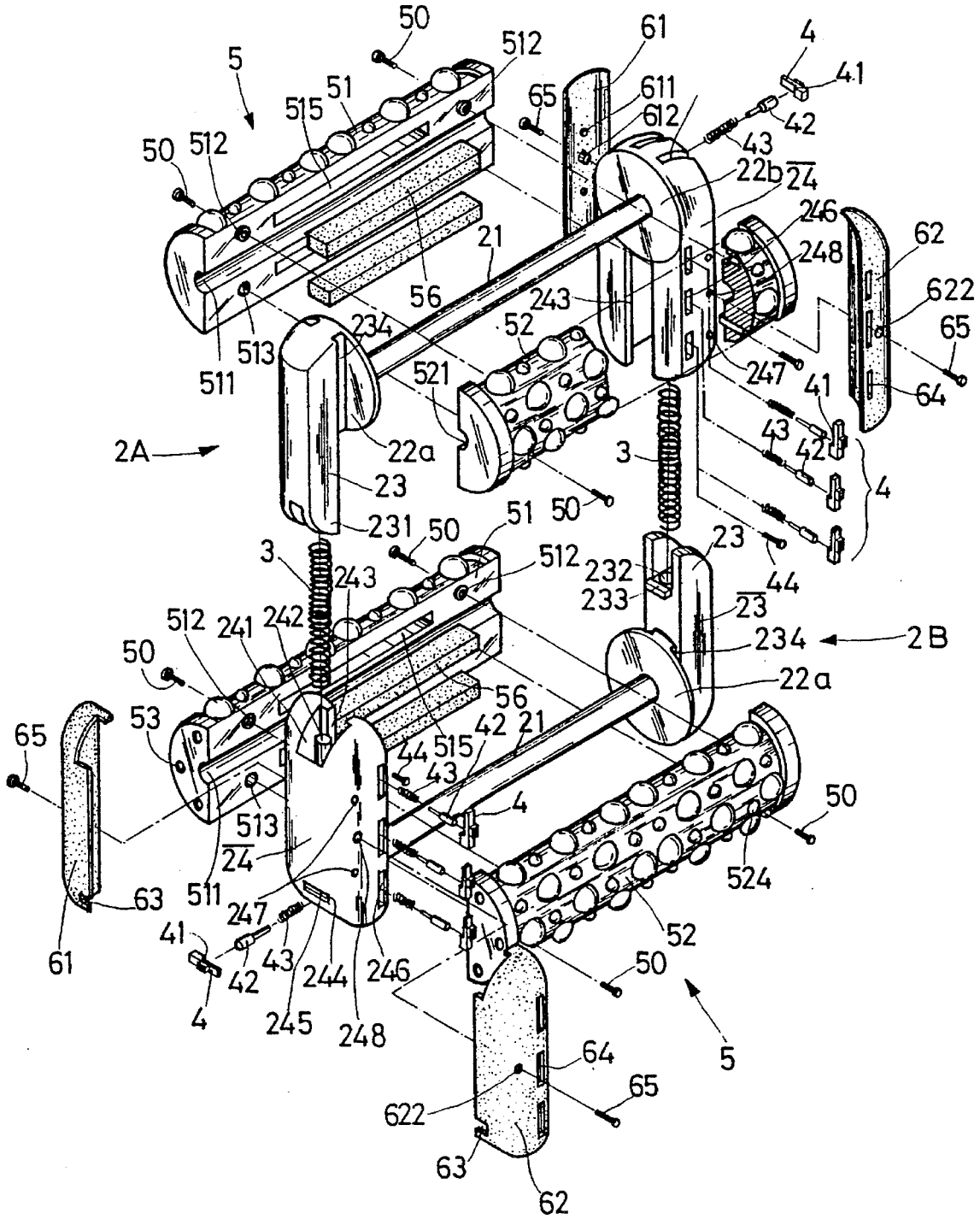
FIG. 4 is an exploded perspective view of the multi-functional handgrip shown in FIG. 3.

Referring to FIGS. 3 and 4, the handgrip made according to this invention generally comprises a pair of U-shape frame 2A, 2B which has the same configuration and both of the U-shape frames are symmetric with each other. The U-shape frame 2A, 2B include a connecting rods 21 and each of the connecting rods 21 is disposed with a projected portion 22*a*, 22*b* respectively. An insert 23 is formed at the projected portion 22*a*. The distal end of the insert 23 is provided with a pair of lugs 231 which defines a slot 232 therebetween. A wedge 233 is provided at the back of the projected portion 22*a*. A connecting block 24 is provided at the external portion of the projected portion 22*b*. A receiving slot 241 is formed within the connecting block 24. A guiding post 242 is disposed within the receiving slot 241. A cutoff 243 is disposed within the connecting block 24 which is narrower than the receiving slot 241. By this arrangement, the slot 234 of the insert 23 can be received thereof. A cutting slot 244 is provided at the connecting block 24 with respect to the lugs 231 of the insert 23. Besides a horizontal slot 245 is disposed at the connecting block 24 adjacent to the connecting rod 21. At the edge of the connecting block 24, three vertical slots 246 are provided thereof. The connecting block 24 is also provided with a hole 247 at the upper and lower portion. A fisheye threaded hole 248 is provided at the middle portion. By this arrangement, the insert 23 of the U-shape frame 2A can be received by the receiving slot 241 of the connecting block 24 of the U-shape frame 2B. In the same manner, the insert 23 of the U-shape frame 2A is received by the receiving slot 241 of the connecting block 24 of the U-shape frame 2B.

A pair of coil springs 3 are disposed within the vertical slot 232 of the insert 23 respectively. The coil springs 3 are also received by the guiding post 242 of the connecting block 24.

A plurality of stacks 4 are disposed within the horizontal slot 245 and the vertical slot 246. Each of the stack 4 has an inclined slot 41 which has installed with a pin 42 and a biasing spring 43.

A pair of holding bars 5 which are composed of two halves 51, 52 are locked to the connecting rod 21 by means of the screw 50. The halves 51, 52 have an arc slot 511, 521 at the middle portion respectively. A plurality of holes 53 are provided at the ends face to the connecting block 24.

A pair of cover 6A, 6B have a curve configuration 61, 62 suitable for being attached to the surface of the connecting block 24. A pair of slots 63, 64 are provided with respect to the horizontal slot 245 and the vertical slot 246. By this arrangement, the stacks 4 project outward the surface.

By this arrangement, the handgrip made according to this invention is made.

Figure 5:
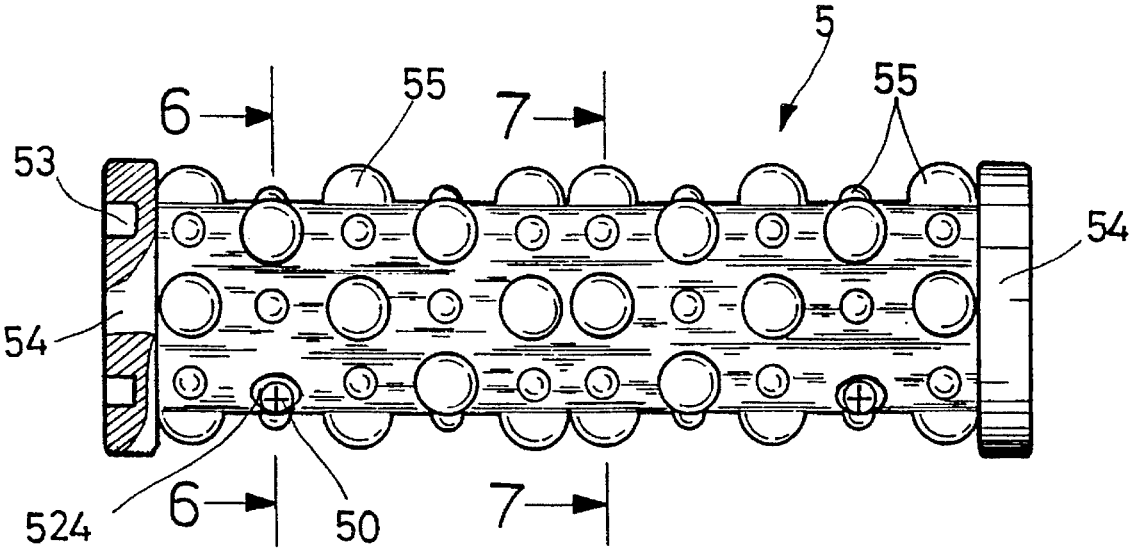
FIGS. 5 is a side elevational view of the holding bar of the handgrip made according to this invention.
Figure 6:
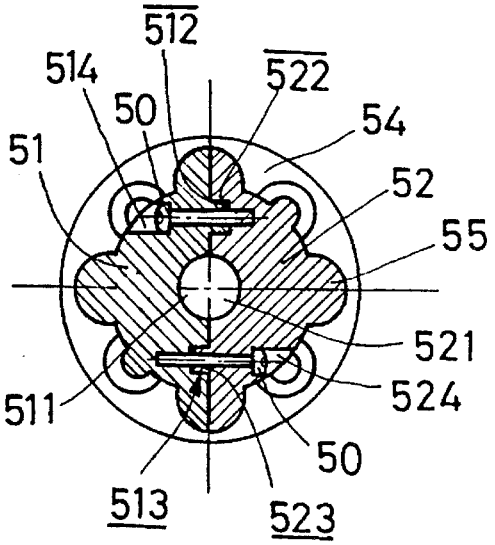
FIG. 6 is a cross sectional view of the holding bar taken from the section line 6—6 of FIG. 5.
Figure 7:
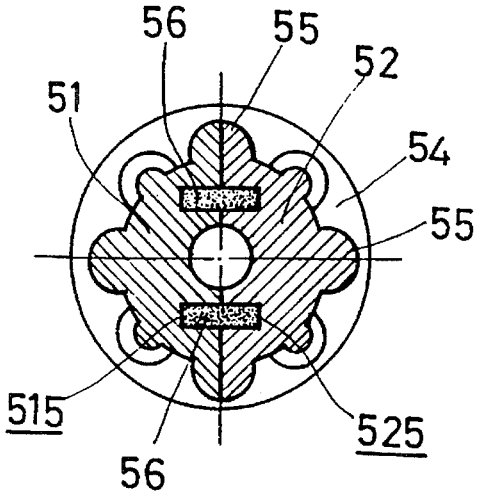
FIG. 7 is a cross sectional view of the holding bar taken from the section line 7—7 of FIG. 5.

Referring to FIGS. 5, 6 and 7, the holding bar 5 consists two halves 51, 52. The inner surface of the half 51 is provided with a boss 512 and a circular recess 513. On the other hand, the half 52 is also provided with a circular recess 522 and a boss 523 to mate with the boss 512 and the circular recess 513 of the half 51. By this arrangement, the two halves 51, 52 can be readily interconnected through the engagement of the circular recess 522 and a boss 523 and the boss 512 and the circular recess 513 of the half 51. A screw 50 is used to screw into the fisheye threaded hole 514, 524 to lock up the two halves 51, 52. Accordingly, a holding bar 5 is constructed.

The assembled holding bar 5 has a flange portion 54 at both ends. Besides, the outer surface of the holding bar 5 is provided with a plurality of randomly disposed projections 55. When the hand of the user grasps on the holding bar 5, those projections 55 will provide a concentrated stress to the palm; accordingly, a finger press and massaging effect are achieved. Preferably, the height of the projections 55 is lower than the height of the flange 54.

Besides, at the position adjacent to the slots 511, 512 of those two halves 51, 52, a pair of elongate slot 515, 525 are provided. Each of the elongate slots 515, 525 is received with a permanent magnet 56. By this arrangement, when the holding bar 5 rotates, a magnetic effect will be generated and a positive effect to the recirculation is reached.

Figure 9:
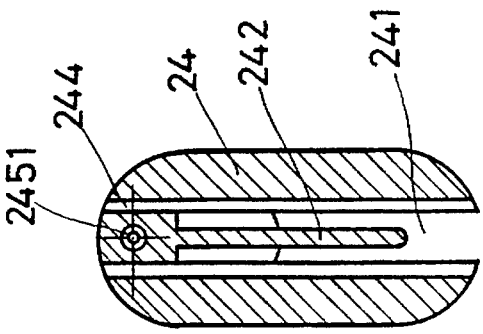
FIG. 9 is a cross sectional view of the U-shape frame taken from section line 9—9 of FIG. 8.
Figure 8:
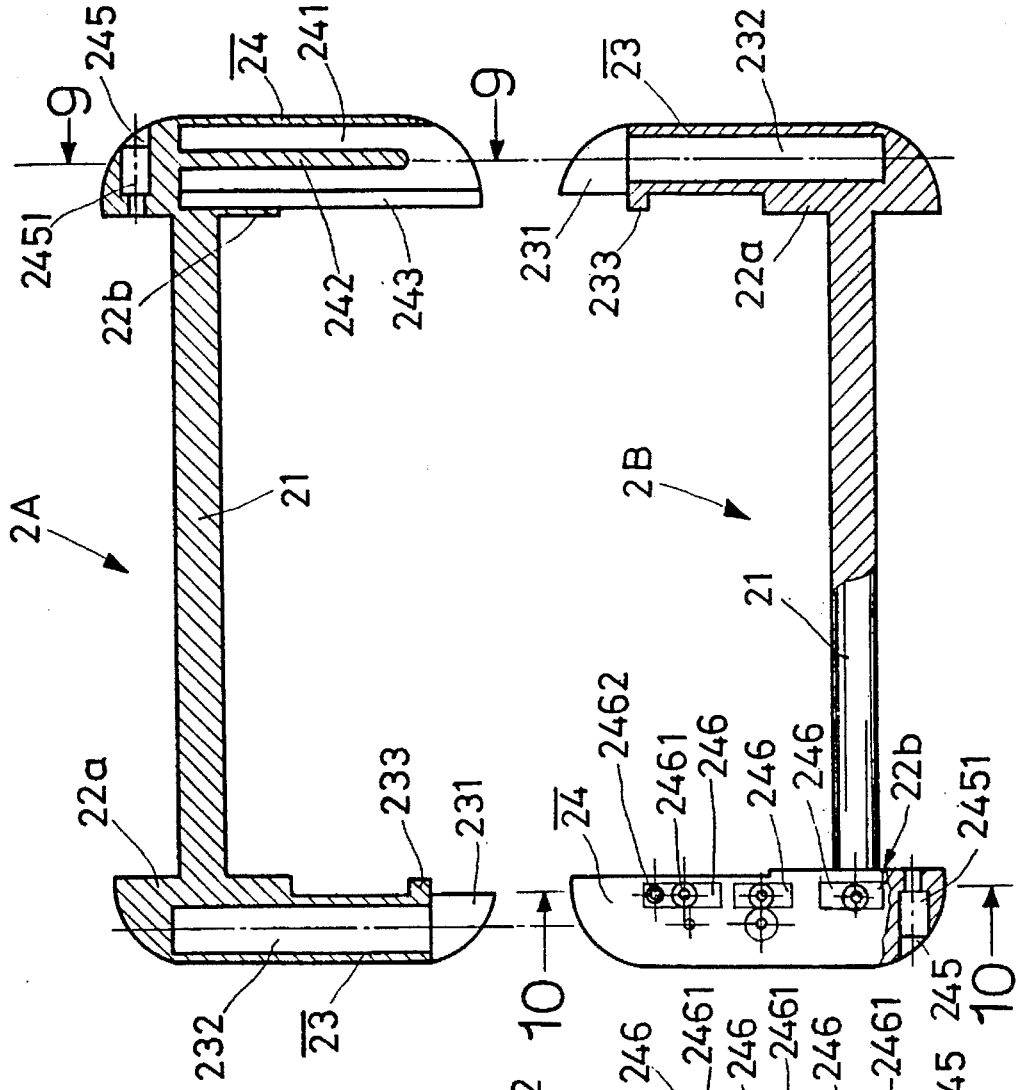
FIG. 8 is a cross sectional view of the U-shape frame of the handgrip made according to this invention.
Figure 10:
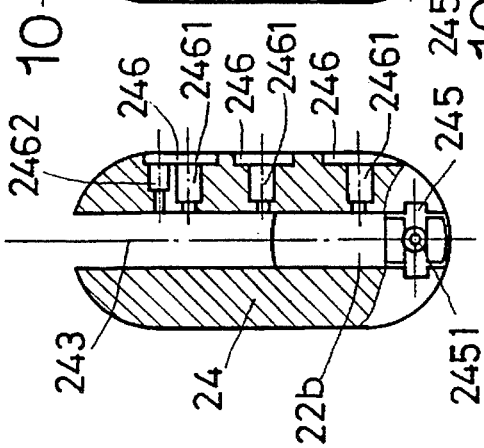
FIG. 10 is a cross sectional view of the U-shape frame taken from section line 10—10 of FIG. 8.

Referring to FIGS. 8, 9 and 10, the inner configuration of those two U-shape frame 2A, 2B. Those two U-shape frame 2A, 2B have an identical inner configuration. Accordingly, the insert 23 can be received by the connecting block 24 of each other.

Referring to FIGS. 8 and 9, for a better and clear understanding to the U-shape frame 2A, 2B, the horizontal slot 245 of the connecting block 24 is provided with a fisheye threaded hole 2451. On the other hand, the vertical slot 246 of the connecting block 24 is also provided with a fisheye threaded hole 2461. Besides, a further fisheye threaded hole 2462 is provided at the utmost vertical slot 246 to receive a retaining pin 44, as clearly shown in FIG. 4. A retaining pin 42 is also slidably disposed within the other fisheye threaded holes 2451 and 2461 respectively.

Figure 11:
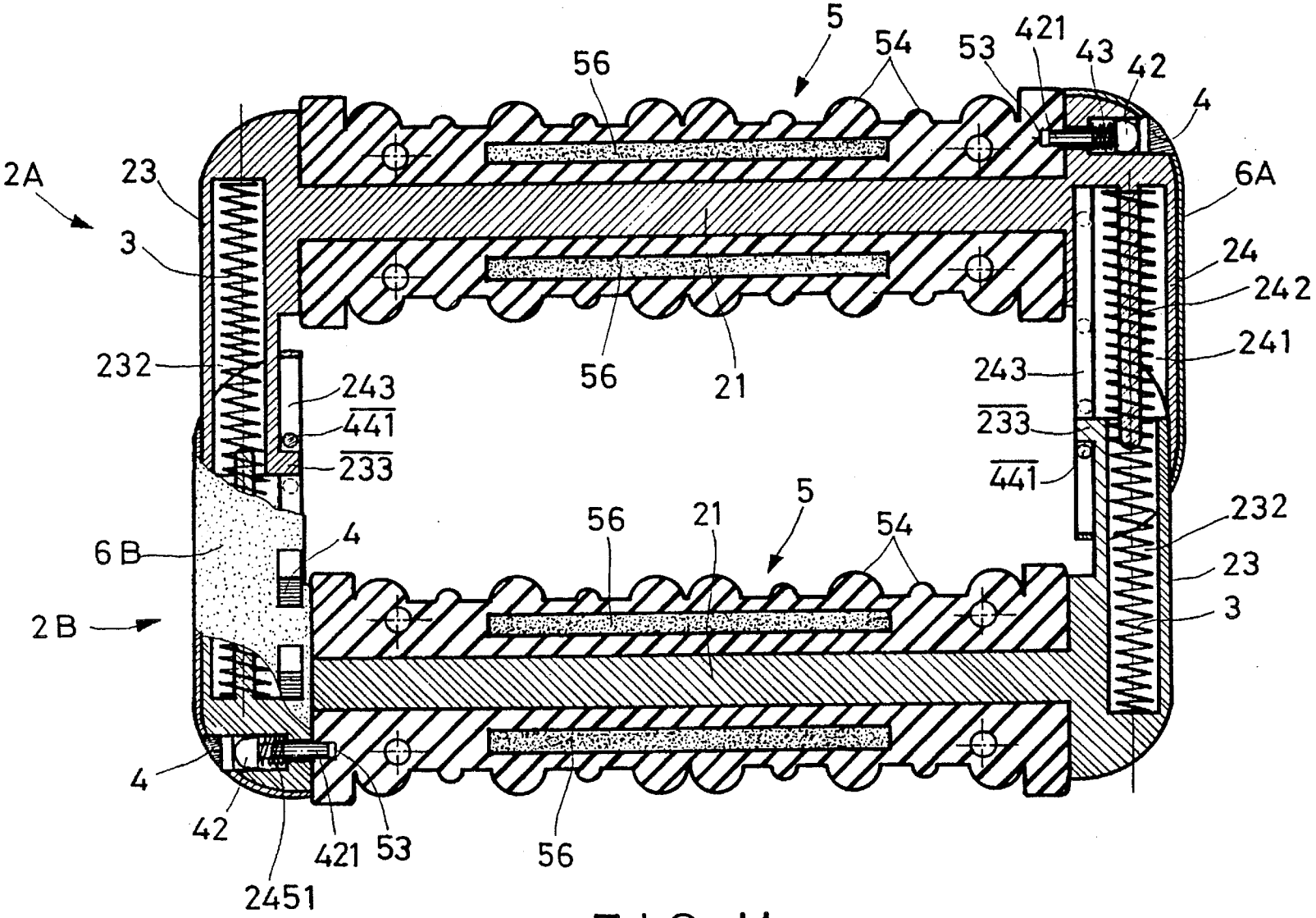
FIG. 11 is a cross sectional view of the assembled U-shape frame made according to this invention.
Figure 12:
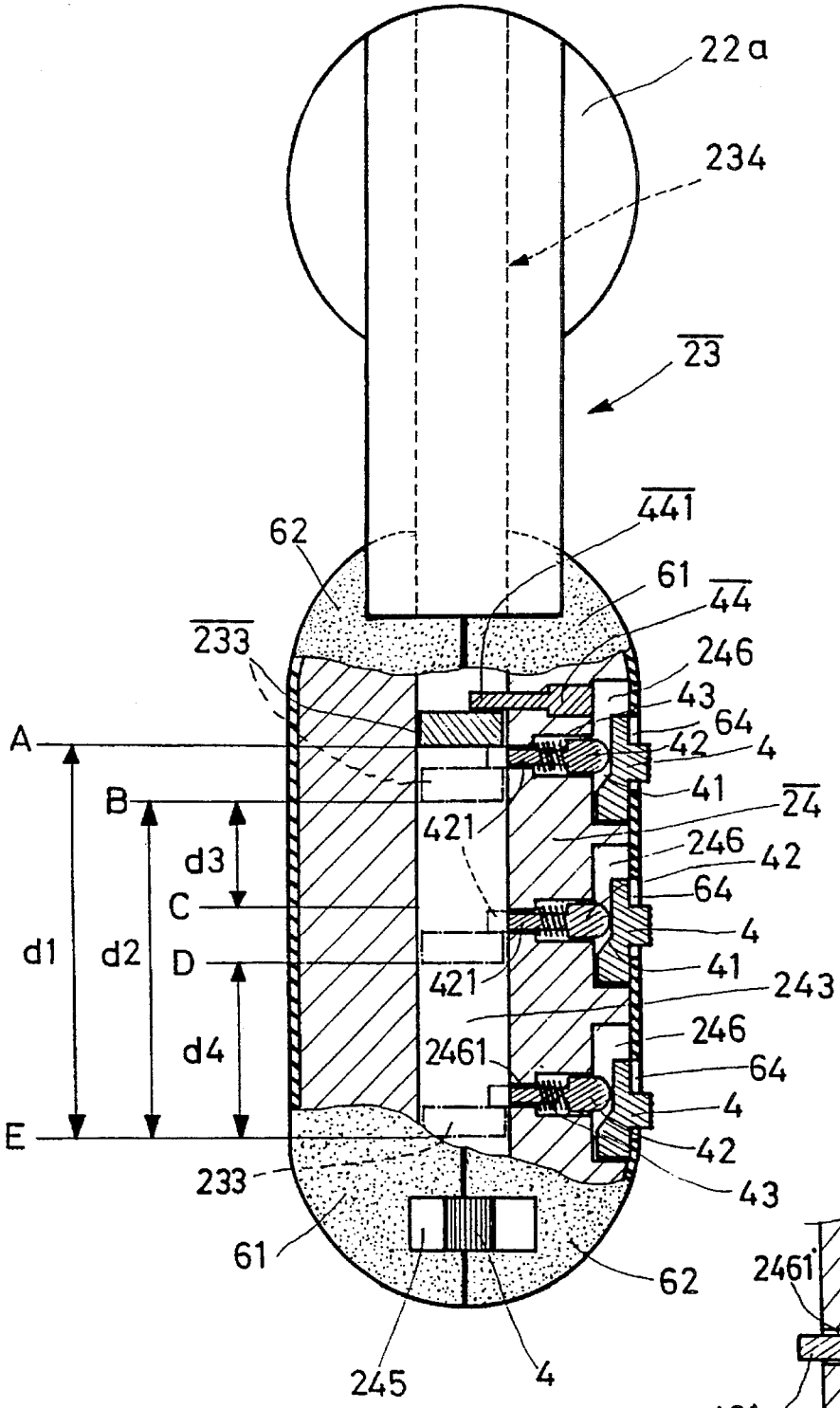
FIG. 12 is a cross sectional view of the positioning means of the handgrip made according to this invention.
Figure 12:
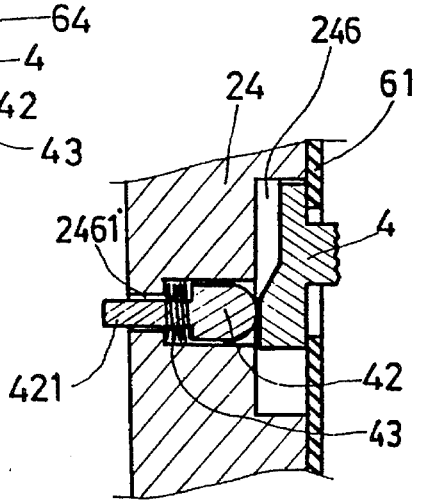

Referring to FIGS. 11, 12, the cross sectional view of the handgrip which is completely assembled. When the U-shape frame 2A, 2B are slidably engaged with each other, the retaining pin 44 is inserted into the connecting block 24 in such a manner that one end 441 of the retaining pin 44 projects into the slot 243 of the connecting block 24. Accordingly, the wedge 233 of the insert 23 is pressed downward. By this arrangement, both U-shape frame 2A and 2B are retained with each other. Meanwhile, the spring 3 will push those U-shape frame 2A, 2B away from each other, as clearly shown in FIG. 12.

When the stack 4 disposed within each vertical slot 246 is off, the stack 4 is pushed against the inclined slot 41 of the stack 4 by the biasing spring 43 in such a manner that the retaining end 421 of the retaining pin 42 is retained within the fisheye 2461, but is away from the slot 243 of the connecting block 43. By this arrangement, the insert 23 is capable of moving from the A point to the E point with the connecting block 24 when an external force is applied. In this case, the torque is d1 and the insert 23 is movable within this range.

Further, if the wedge 233 is pushed forward to the B point, the stack 4 is on, as clearly shown in FIG. 12A, the stack 4 is pushed by the retaining pin 42 in such a manner that the retaining end 421 projects into the slot 243. As a result, the insert 23 is received within the connecting block 24 and is moveable from B point to E point. In this case, the torque is d2. By the same principle, when the stack 4 in the middle position is on, the retaining end 421 of the retaining pin 42 projects into the slot 243 of the connecting block 24. In this case, the insert 23 is movable within the connecting block 24 from B point to C point. As a result, the torque is d3. Of course the wedge 4 at the upper position can be off, then the retaining pin 42 is retracted from the slot 243 of the connecting block 24, then the wedge 233 can be compressed from A point to C point. By the same reason, the wedge 233 of the insert 23 can be compressed from D point to E point and a d4 torque is achieved. At the last stage, the insert 23 can be completely received within the connecting block 24, if the stack 4 is closed in this case, the insert 23 will be locked within the connecting block 24.

When the holding bar 5 is grasped, the holding bar 5 shall be retained from rotating freely. Hence, the stack 4 within the horizontal slot 245 shall be released to lock into the hole 53 of the holding bar 5. By this arrangement, the holding bar 5 is retained from rotating freely. On the other hand, the actuating of the stack 4 within the horizontal slot 245 is identical to the disclosure shown in FIG. 12A.

Figure 13:
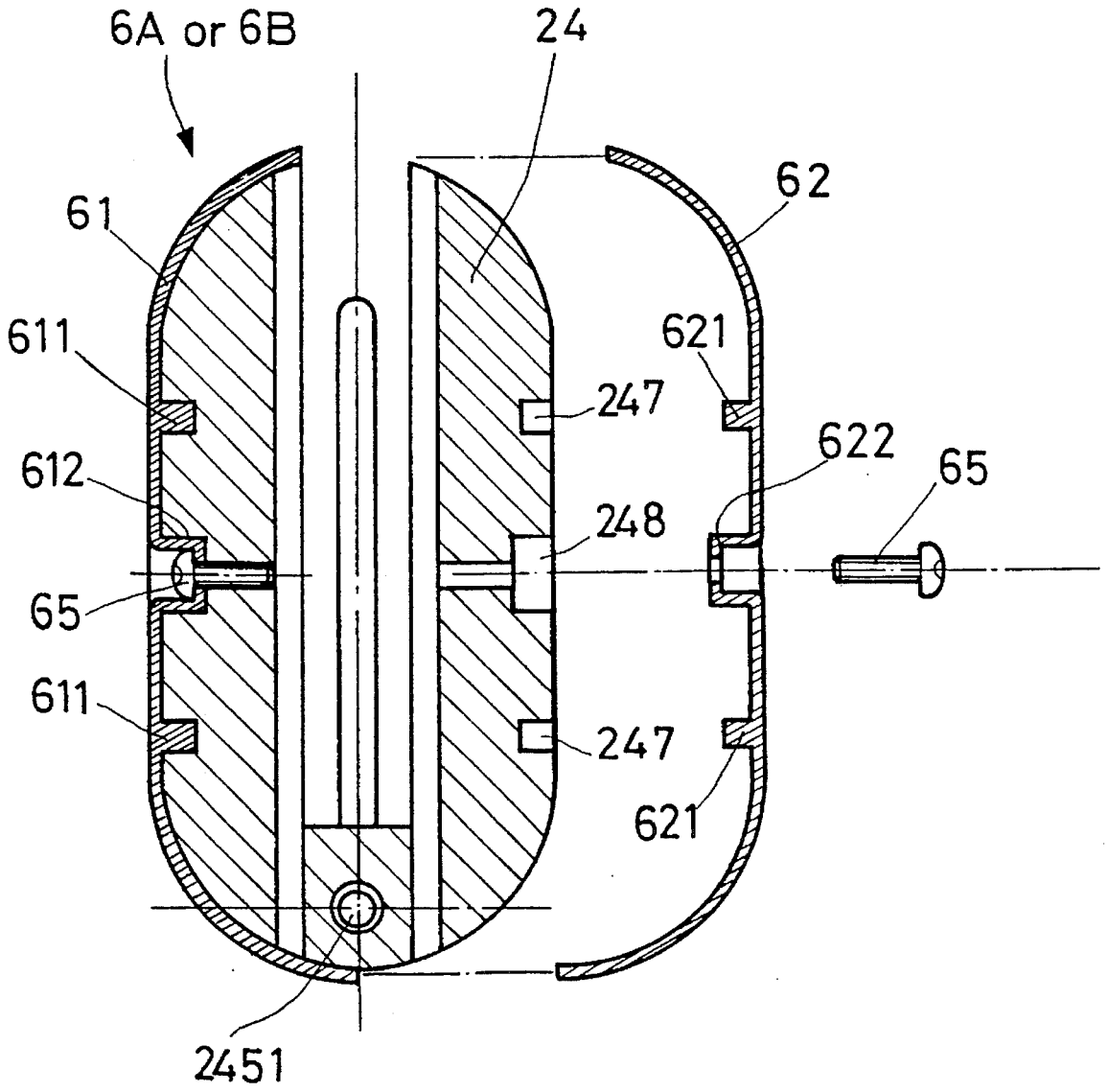
FIG. 13 is a cross sectional view of the cover of the handgrip made according to this invention.

As shown in FIG. 13, a pair of cover 6A, 6B have a curve configuration 61, 62 are suitable for being attached to the connecting block 24. Each of the curve configurations 61, 62 is provided with a positioning boss 611, 612 with respect to the hole 247 of the connecting block 24 respectively. A projection 612, 622 are provided at the curve configuration 61, 62 respectively with respect to the fisheye threaded hole 248. Accordingly, an easy engagement with the surface of the connecting block 24 is achieved through a screw 65. By this arrangement, the stacks 4 are all retained within the horizontal slot 245 and vertical slot 246 without being removed thereof.

Now the functions and applications of the handgrip made according to this invention will be clearly illustrated in conjunction with the drawings.

Figure 14:
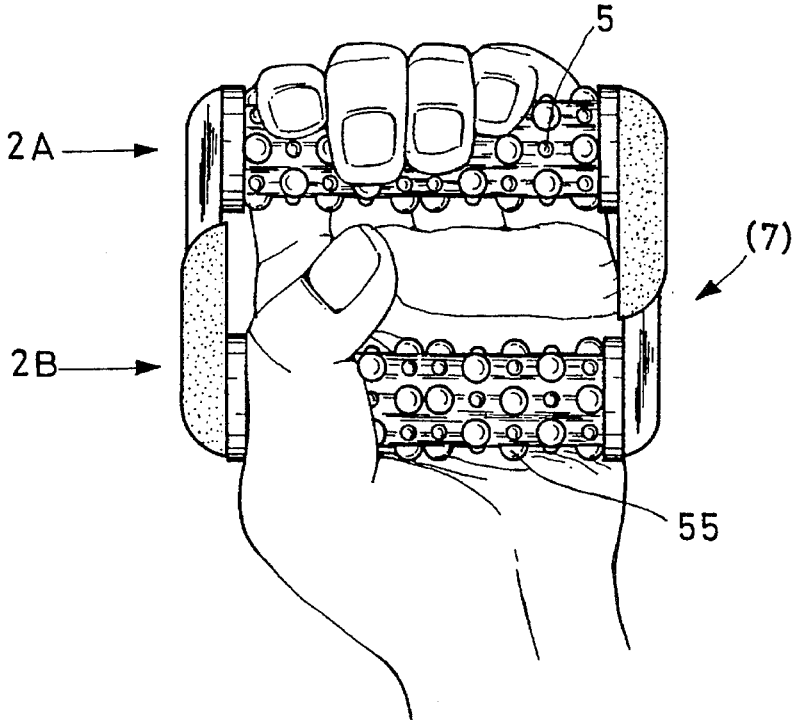
FIG. 14 is a sketch view of the handgrip which is held by a user's hand.
Figure 15:
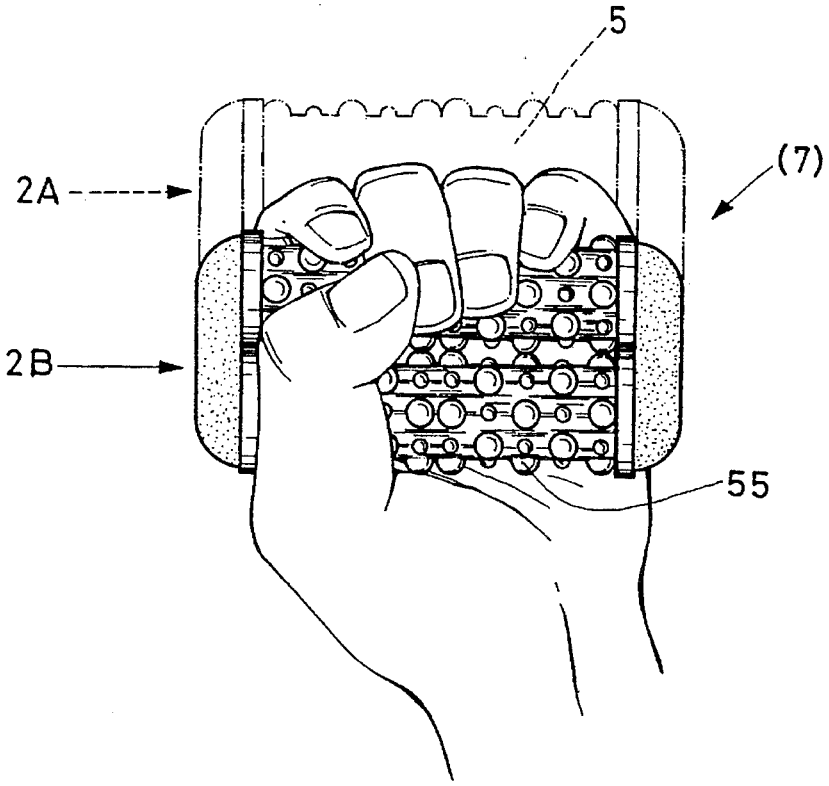
FIG. 15 is a sketch view of the handgrip wherein the holding bars are moved toward each other.

Referring to FIGS. 14, 15, the handgrip made according to this invention can be used as a handgrip 7. The holding bar 5 can be locked up to prevent it from rotating. The operating torque between those U-shape frame 2A, 2B can be readily adjusted to d1, d2 or d3 according to different working loads. While the holding bars 5 are moved toward each other, the projections 55 thereof will provide an excellent massaging effect to the palm. The user can get two different results in a single operation.

Figure 16:
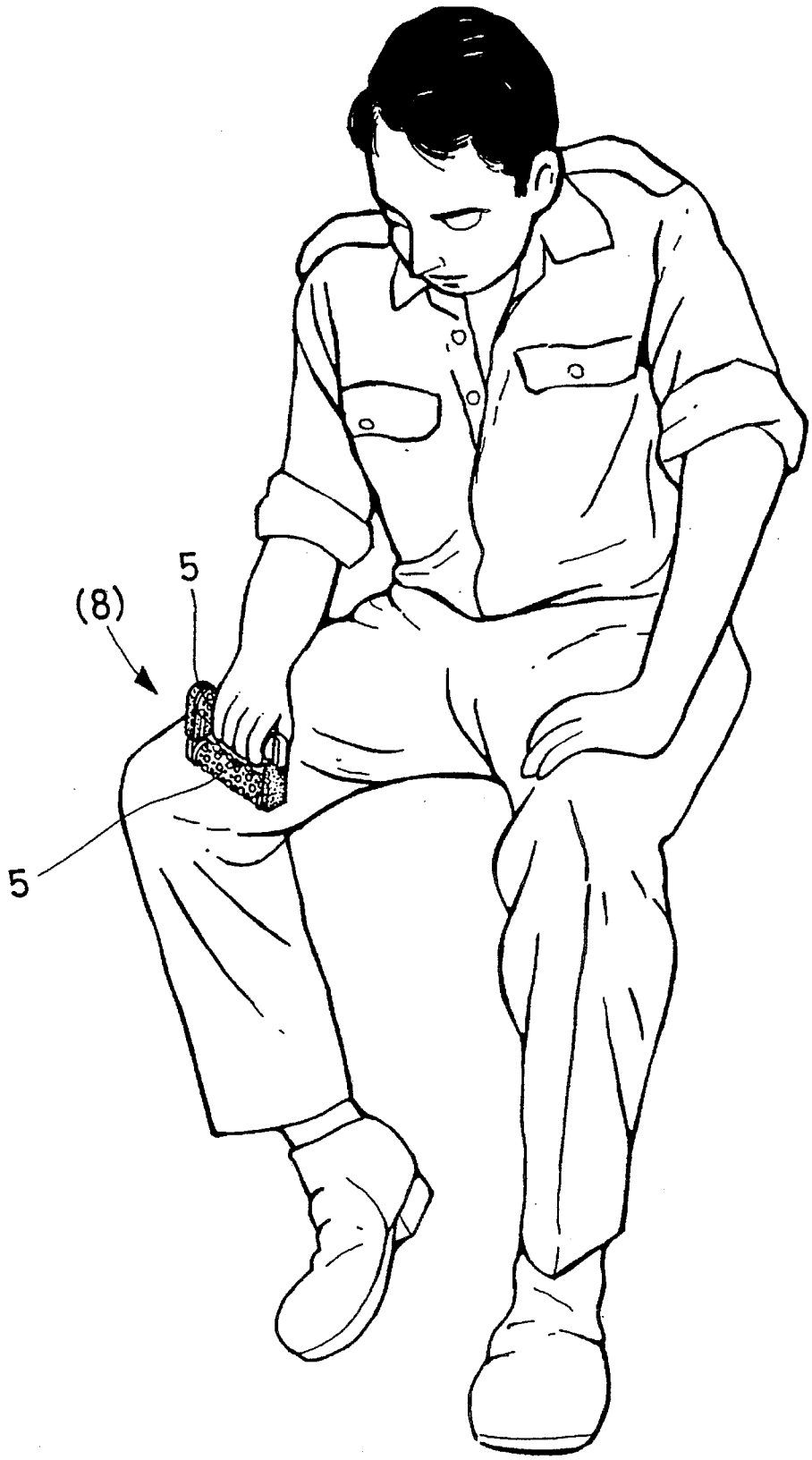
FIG. 16 is a sketch view of the handgrip wherein the holding bar is used as a massaging bar.

Referring to FIG. 16, the handgrip made according to this invention can be used as a massager 8. One of the holding bar 5 is locked and the other one is released to rotate freely, on the other hand, the U-shape frame 2A, 2B are positioned with each other. By this arrangement, the handgrip can be used as an excellent massager to each part of the body.

Figure 1:
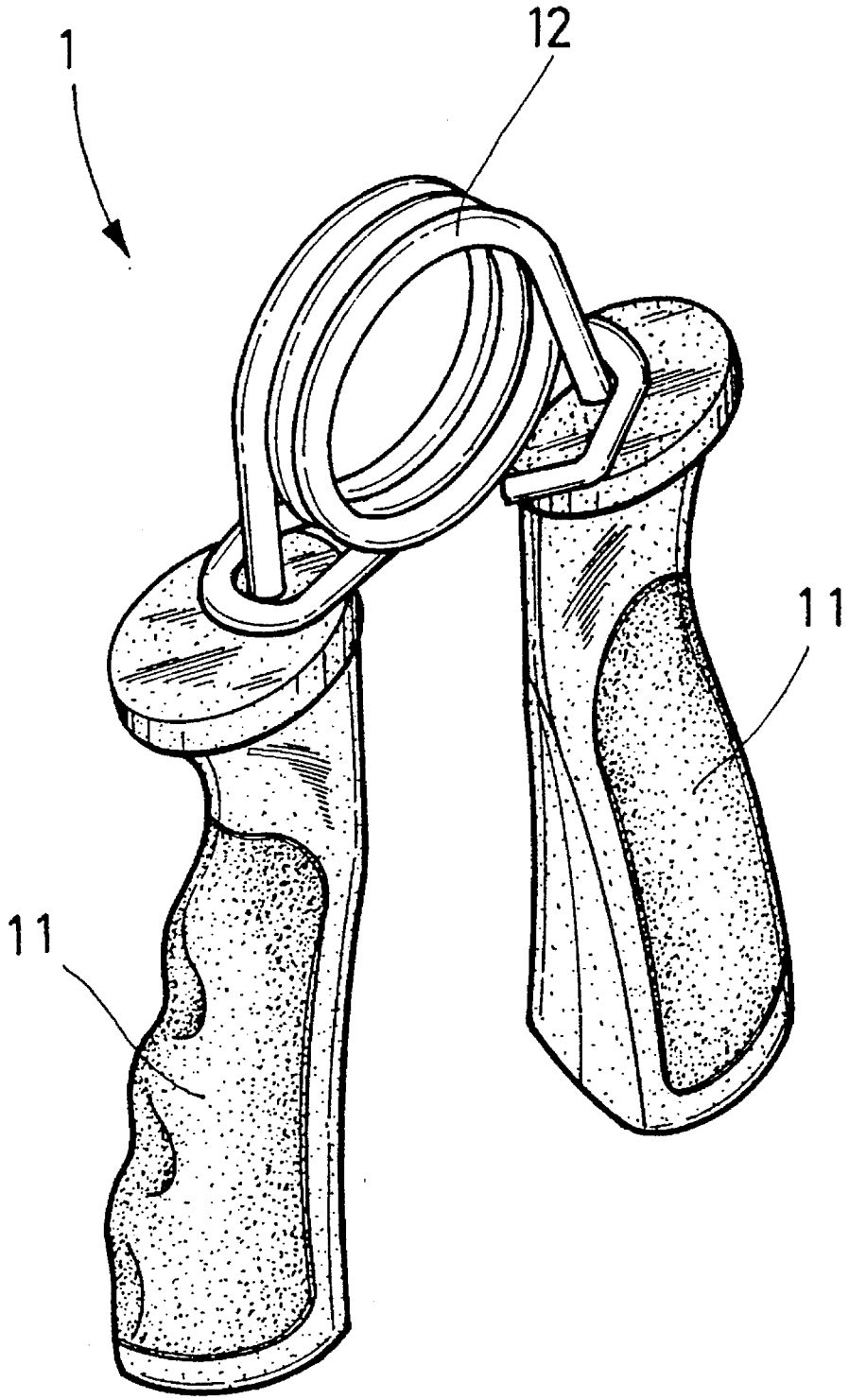
PRIOR ART FIG.1
FIG. 1 is a perspective view of a conventional handgrip.
Figure 2:
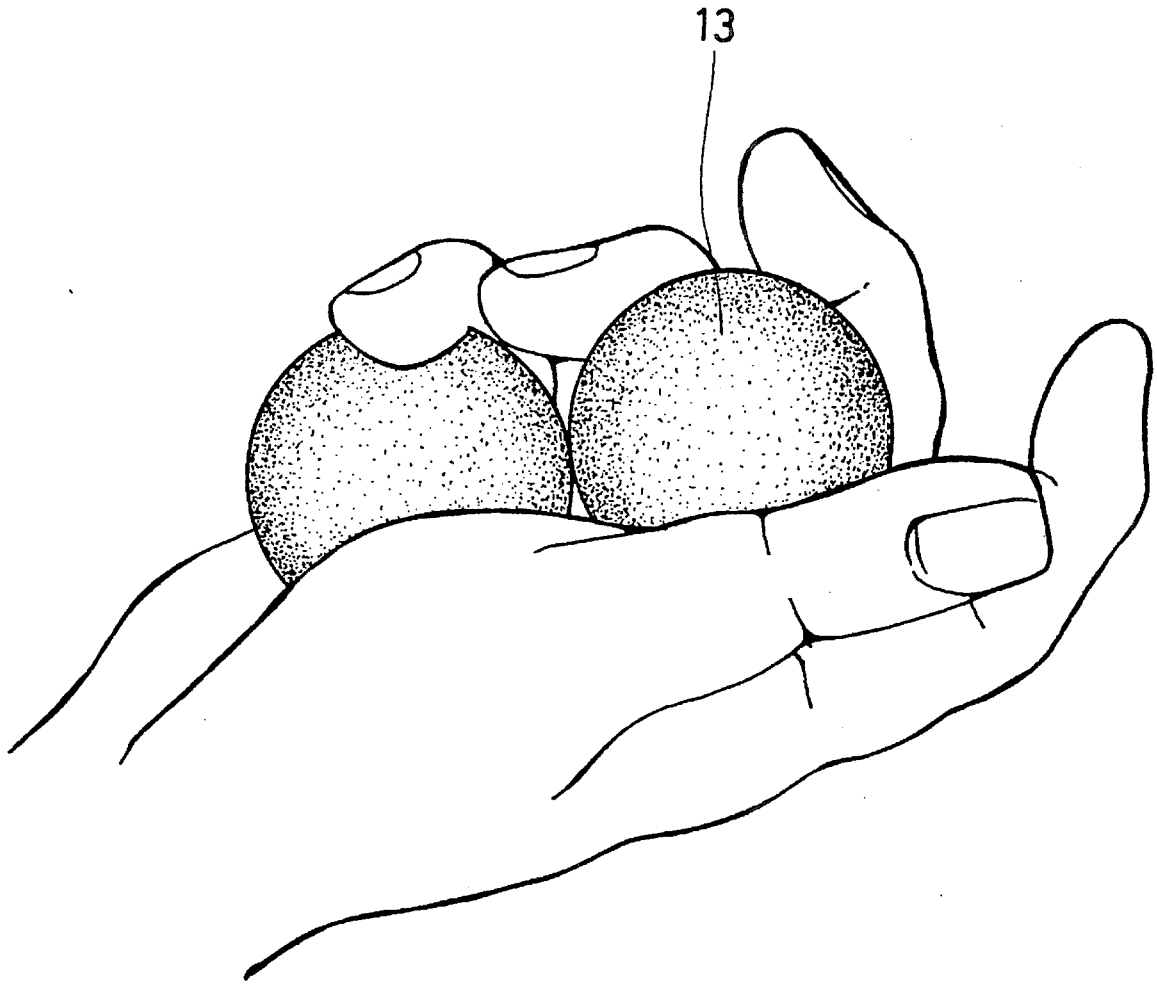
PRIOR ART FIG. 2
FIG. 2 is a perspective view of a pair of conventional metal balls.
Figure 17:
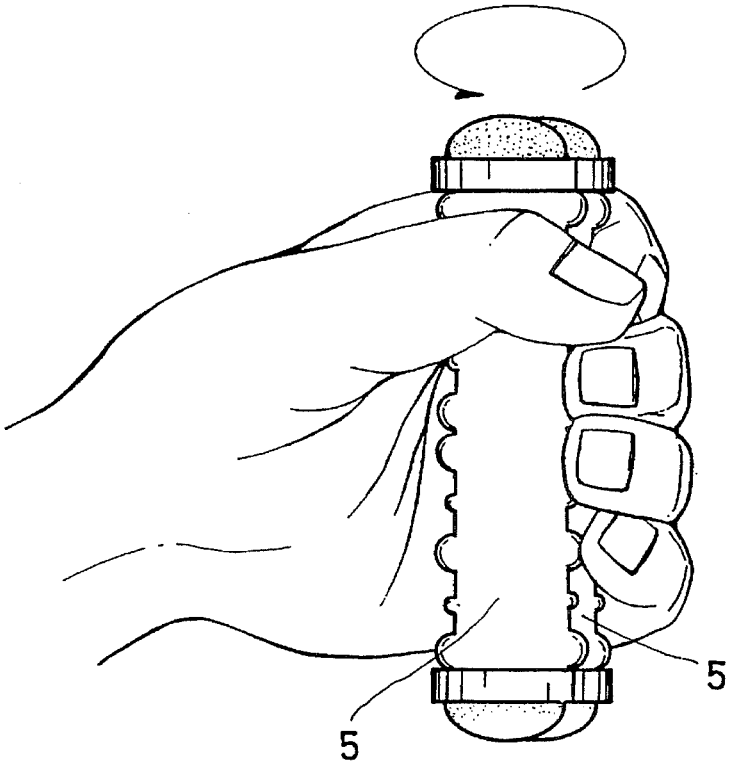
FIG. 17 is a sketch view of the handgrip wherein the holding bars are held within the user's hand.
Figure 18:
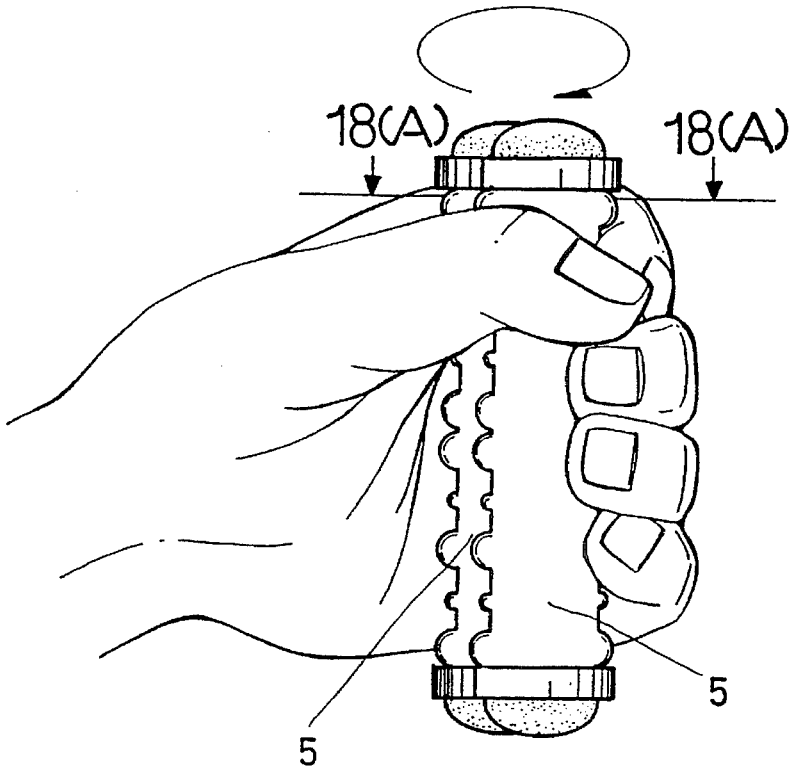
FIG. 18 is a sketch view of the handgrip wherein the holding bars are spinning within the user's hand.
Figure 18:
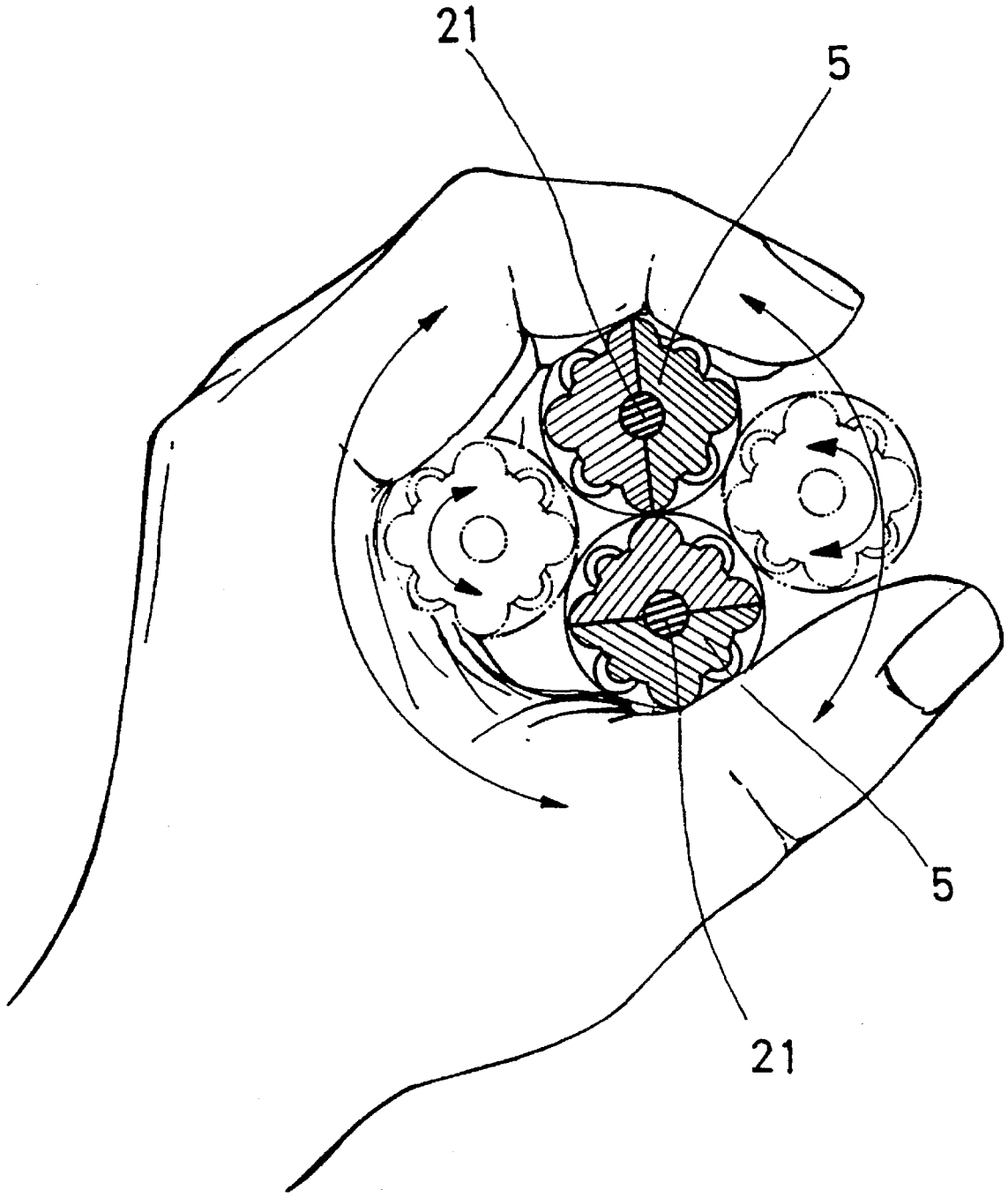

As shown in FIGS. 17 and 18, the handgrip made according to this invention can be used as a rotator 9. As described above, the U-shape frame 2A, 2B can be compressed to the shortest distance, accordingly, no torque exists therebetween. Each of the holding bars 5 are released to rotate freely. As a result, each holding bar 5 can spin with the other holding bar 5 freely to provide a result of the metal balls, as shown in FIG. 2. On the other hand, the magnet field generated by the permanent magnet 55 of the holding bar 5 will play a positively effect to the recirculation of the hand. In light of this, the handgrip made according to this invention can replace the conventional metal balls to massage the center of the palm.

Figure 19:
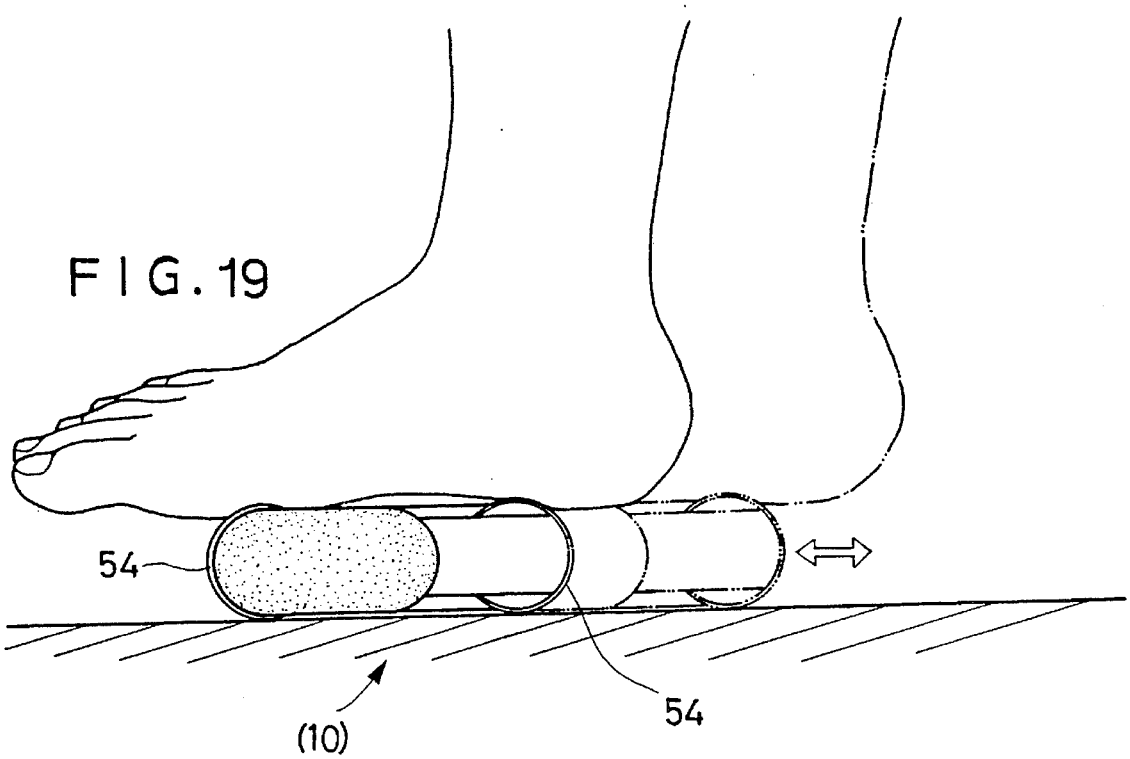
FIG. 19 is a sketch view showing the handgrip is used as a massager and works on the sole.
Figure 20:
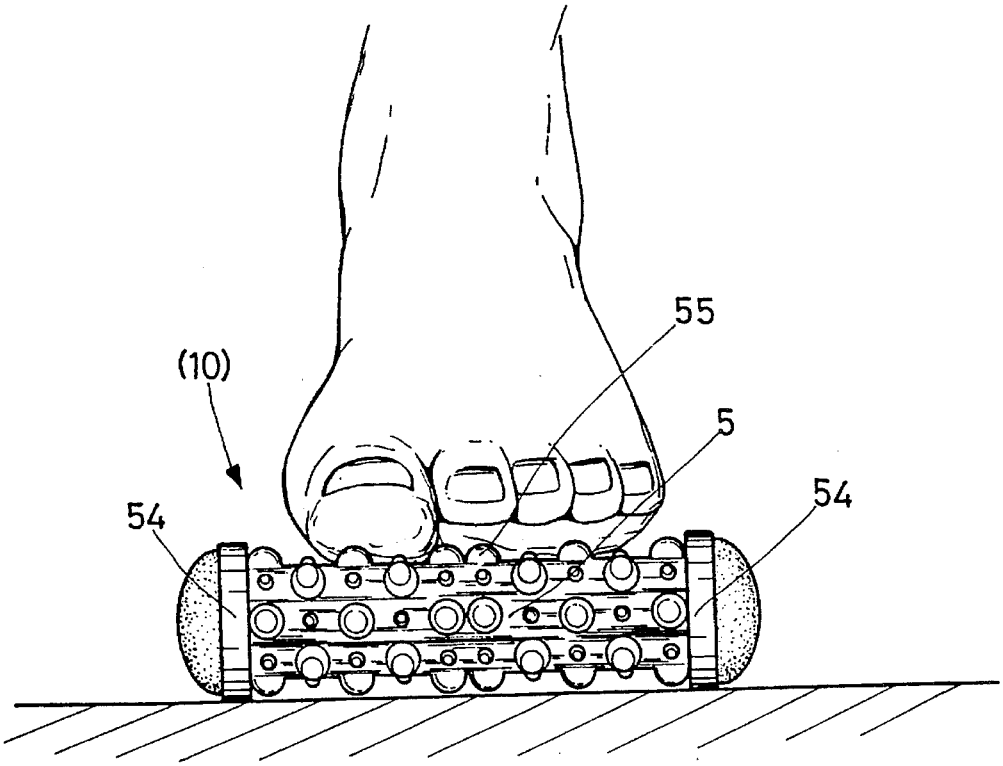
FIG. 20 is a sketch view showing the handgrip and the sole in another direction.

As shown in FIGS. 19, 20, the handgrip made according to this invention can be used as a sole massager 10. As described above, the holding bars 5 are released to rotate freely and the flanges 54 will have a function of wheels. Then the projections 55 of the holding bars 5 will press against the sole of the leg. An excellent effect can also be achieved.

Although the present invention has been described in connection with the preferred embodiment, many other variations and modifications will now become apparent to those skilled in the art without departing from the scope of the invention. It is preferred, therefore, that the present invention not be limited by the specific disclosure herein, but only by the appended claims.

I claim:

1. A multi-functional handgrip comprising:

a pair of U-shaped frames slidingly coupled together and biased apart by a pair of coil springs, each of said U-shaped frames including:

a connecting rod extending in a longitudinal direction and having first and second projecting portions formed on opposing ends thereof;

an insert block having an inner side coupled to said first projecting portion, said insert block including a wedge lip formed on said inner side thereof and protruding toward said opposing end of said connecting rod, said insert block having a distal end with a pair of lugs extending therefrom in a direction orthogonal said longitudinal direction and defining a lug slot therebetween;

a connecting block being affixed to said second projecting portion and having a receptacle portion extending in a direction transverse said longitudinal direction, said receptacle portion having a receiving slot formed therein and extending in said transverse direction for receipt of said insert block of the other of said U-shaped frees, said receiving slot having a guiding post extending from a bottom wall of said receiving slot, said connecting block further including four stack receiving slots formed therein each being positioned coaxial a respective fish eye shaped hole, a first of said fish eye shaped holes being positioned adjacent to said connecting rod, a second, third and fourth fish eye shaped hole being positioned in a linearly spaced arrangement along an edge of said receptacle portion of said connecting block wherein said fourth stack receiving slot is positioned adjacent said distal end of said receiving slot;

a respective one of said pair of coil springs being positioned within said receiving slot of said connecting block and concentrically around said guiding post;

a plurality of stacks, each of said plurality of stacks being slidingly retained within a respective one of each of said stack receiving slots, each said stack having a first edge and a second inclined edge for providing camming surfaces for abutment against a spring biased retaining pin to selectively withdraw and extend a distal end of said retaining pin through a respective one of said coaxial fish eye shaped holes;

a longitudinally directed holding bar concentrically mounted about said connecting rod, said holding bar formed by joining first and second longitudinally directed holding bar halves, each of said holding bar halves including a recess for receiving a longitudinally extended portion of said connecting rod therein, said holding bar having a plurality of holes formed in an end thereof disposed adjacent said connecting block; and, a pair of connecting block covers attached to opposing sides of said connecting block, said covers being provided with a plurality of slots disposed in aligned relation with a respective one of said four stack receiving slots.

2. The configuration recited in claim 1, where each of said holding bar halves includes a plurality of projecting bosses and a plurality of respective circular recesses for connection of one said half with the other.

3. The configuration recited in claim 1, where said holding bar includes a pair of flanges formed on opposing ends thereof, said holding bar having a plurality of projections extending from an outer surface thereof for providing a massaging effect.

4. The configuration recited in claim 1, where each holding bar half has a longitudinally directed slot formed in an interior surface thereof, said holding bar including a permanent magnet disposed at least partially in said slot of each said holding bar half.

5. The configuration recited in claim 1, where each of said covers of said connecting block includes a positioning boss to be received by a respective hole formed in said connecting block.

* * * * *